US006178640B1

(12) United States Patent
Votolato

(10) Patent No.: US 6,178,640 B1
(45) Date of Patent: Jan. 30, 2001

(54) SLITTER DEVICE

(75) Inventor: Earl Votolato, Newport Beach, CA (US)

(73) Assignee: Spellbound Development Group, Inc., Irvine, CA (US)

( * ) Notice: Under 35 U.S.C. 154(b), the term of this patent shall be extended for 0 days.

(21) Appl. No.: 09/370,192

(22) Filed: Aug. 9, 1999

(51) Int. Cl.[7] ..... B26B 3/08
(52) U.S. Cl. ..... 30/2; 30/294
(58) Field of Search ..... 30/2, 151, 286, 30/289, 294

(56) References Cited

U.S. PATENT DOCUMENTS

| | | | | |
|---|---|---|---|---|
| 365,714 | | 6/1887 | Warner | 30/286 |
| 2,209,751 | | 7/1940 | Wulff | 30/2 |
| 2,231,267 | * | 2/1941 | Giddings | 30/2 |
| 2,291,075 | * | 7/1942 | Hanson | 30/2 |
| 2,376,887 | | 5/1945 | Walters | 30/151 |
| 2,624,936 | | 1/1953 | Jensen | 30/294 |
| 2,730,800 | | 1/1956 | Bailey | 30/2 |
| 2,731,715 | * | 1/1956 | Reiss | 30/2 |
| 2,743,523 | | 1/1956 | Honey | 30/2 |
| 3,230,620 | | 1/1966 | Embleton | 30/294 |
| 3,430,339 | | 3/1969 | Hobson | 30/2 |
| 3,781,988 | | 1/1974 | Jones | 30/2 |
| 4,028,802 | | 6/1977 | Houghton et al. | 30/294 |
| 4,531,286 | | 7/1985 | Vito et al. | 30/2 |
| 4,675,996 | | 6/1987 | DuBuque | 30/2 |
| 4,744,146 | * | 5/1988 | Schmidt | 30/2 |
| 4,980,977 | | 1/1991 | Matin et al. | 30/2 |
| 5,234,436 | | 8/1993 | Eaton et al. | 30/15 |
| 5,241,750 | | 9/1993 | Chomiak | 30/2 |
| 5,285,574 | * | 2/1994 | Feltner | 30/2 |
| 5,522,135 | | 6/1996 | Votolato | 30/2 |
| 5,697,157 | | 12/1997 | Votolato | 30/2 |

* cited by examiner

*Primary Examiner*—Hwel-Siu Payer
(74) *Attorney, Agent, or Firm*—William W. Haefliger

(57) ABSTRACT

In a slitter, the combination comprises a blade having a cutting edge; a holder for the blade, including a handle, and a terminal on the handle retaining the blade with the blade edge protruding; a shield carried by the holder proximate the terminal, for movement between extended position in which the blade is protected, and retracted position in which the blade edge is exposed for cutting, there being a torsion spring carried by the holder and having an arm biasing the shield toward extended position, the spring arm projecting in a hollow defined by the shield; and the shield extending parallel to the blade, at opposite sides thereof.

24 Claims, 6 Drawing Sheets

14
13
~90~
13b
69
65
4
4
63
63a
61a
70a
15
17
11
10
2
2

13
14
15e
64
65
31
32
17
10
30

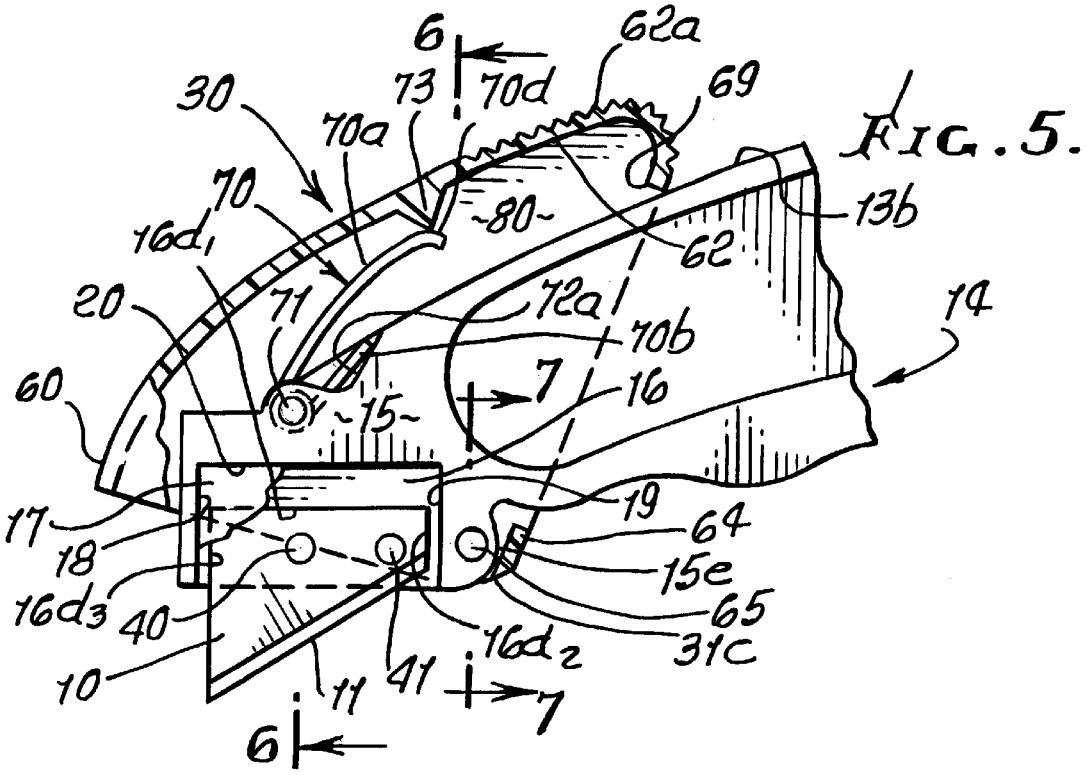
FIG. 5.
FIG. 6.
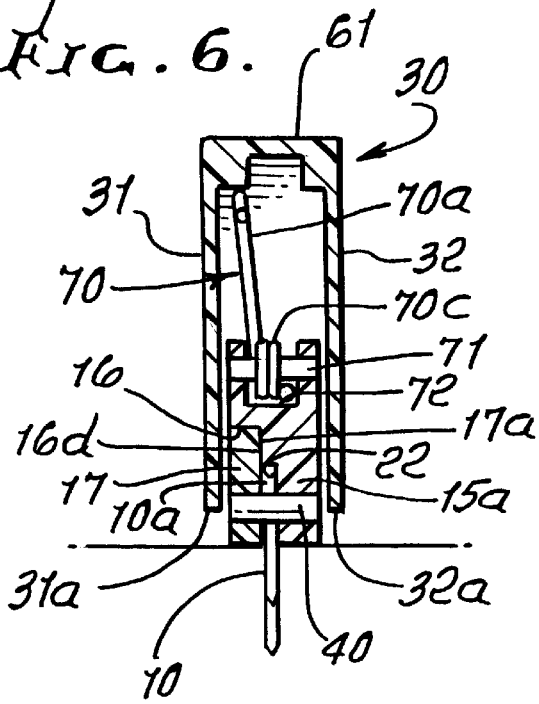
FIG. 7.
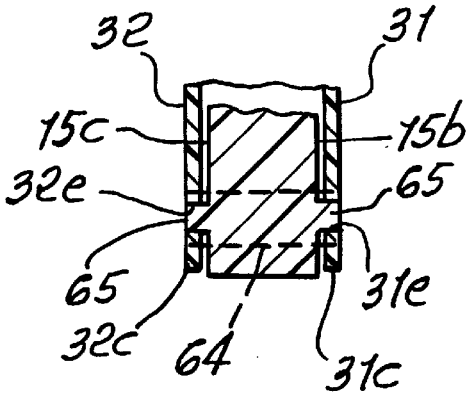

FIG. 12.
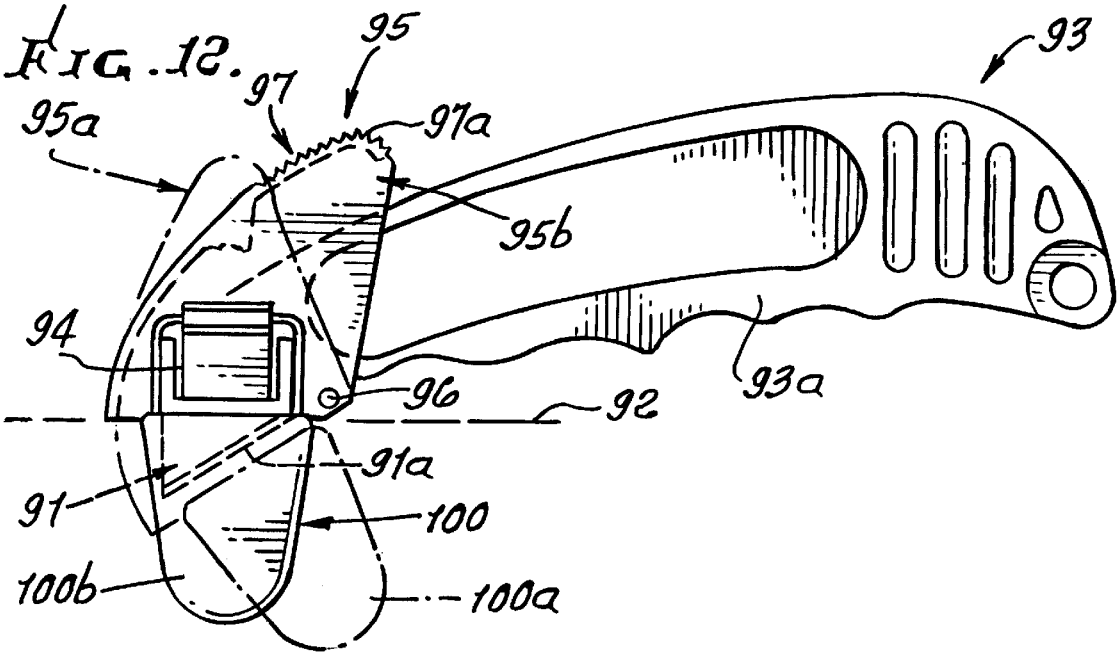
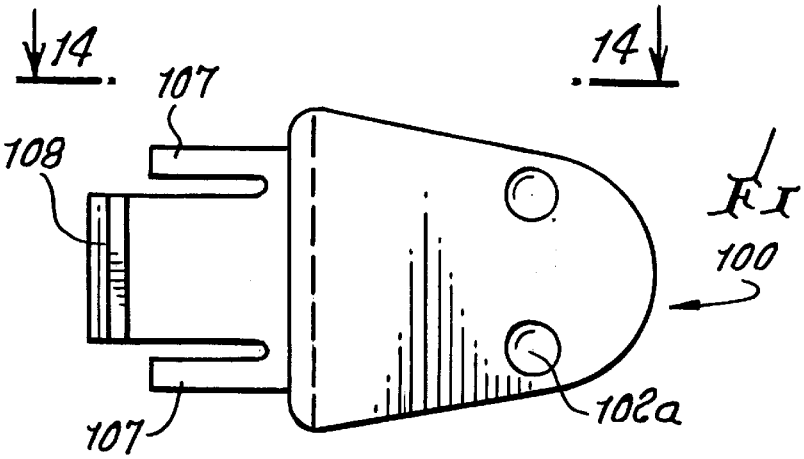
FIG. 13.
FIG. 15.
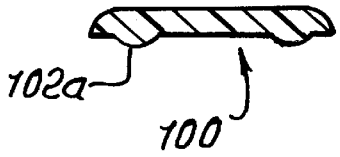
FIG. 14.
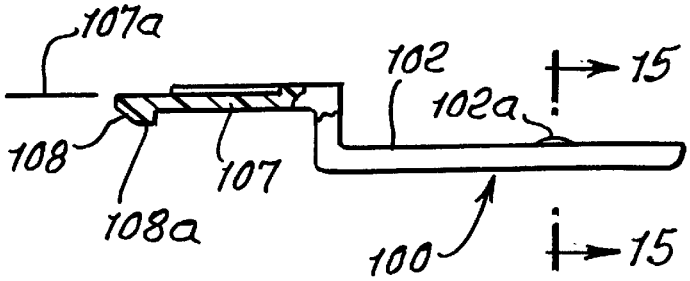

SLITTER DEVICE

BACKGROUND OF THE INVENTION

This invention relates generally to slitting devices, as are used for opening boxes, and more particularly, to an improved device of simple, compact, heavy duty lightweight construction and enabling its throw-away disposal.

There is need for devices, as referred to above, and in particular, there is need for very low cost such devices which are made to be thrown away without danger, which could otherwise be presentd by slitting blade exposure.

SUMMARY OF THE INVENTION

It is a major object to provide an improved box opener in the form of a slitting device of simple, low cost, compact, throw-away construction, and which is safe to use, and safe when thrown away by virtue of blade protection. Basically, the device comprises:

a) a blade having a cutting edge, b) a holder for the blade, including a handle, and a terminal on the handle retaining the blade with the blade edge protruding, c) a shield carried by the holder proximate the terminal, for movement between extended position in which the blade is protected, and retracted position in which the blade edge is exposed for cutting, d) there being a torsion spring carried by the holder and having an arm biasing the shield toward extended position, e) the spring arm projecting in a hollow defined by the shield, the shield having blade protection sections extending parallel to the blade at opposite sides thereof.

As will be seen the holder may typically include a blade retaining insert plate carried by the terminal, the blade carried adjacent the insert plate with the blade edge projecting in skewed relation to the holder, in shield retracted position, the torsion spring biasing the shield toward that extended position.

It is another object of the invention to provide a torsion spring arm having camming engagement with a surface carried by the shield, whereby that surface slides along the spring arm, lengthwise thereof, as the shield moves between retracted and extended positions. As will be seen, that surface is typically defined by a projection on the shield, in the shield.

A further object of the invention is to provide a shield having an uppermost projecting portion extending above the level of holder terminal when the handle extends generally horizontally, for engagement with the user's finger or thumb when the handle is gripped, whereby the shield may be moved to retracted position by finger or thumb pressure exerted on said uppermost portion. The utility knife can be operated two ways. Either the user pulls the blade guard back with his/her thumb or other finger to expose the blade, or the user simply pushes the slitter down on the surface being cut forcing the blade guard to unlock and open thus exposing the blade and start the cutting. This is the preferred way to use the utility knife.

Yet another object is to provide a blade holder including an insert plate carried by the terminal, the blade carried proximate the insert plate with the blade edge projecting in a skewed relation to a lower edge defined by the insert plate, below the torsion spring, the shield having a forward portion extending protectively forwardly of the blade in blade extended position.

A further object is to provide a shield uppermost portion that tapers upwardly and rearwardly above the blades and spring, in shield extended position.

An added object is to provide a cooperative relation between a blade shield and a spring, defined by a) a slitter blade and a handle carrying said blade, b) a shield carried by the handle and pivotable between extended position in which the shield extends in protective relation to the blade, and retracted position, in which the blade is exposed for slitting, c) a spring located to urge the shield toward extended position, d) the spring having an elongated arm, and the shield having a projecting portion defining a hollow to increasingly receive the spring arm as the shield pivots toward extended position, e) said projecting portion of the shield adapted to be gripped to effect shield pivoting.

An additional object is to provide shield opposite side sections at opposite sides of the holder terminal, said opposite side sections pivotally carried by said terminal, generally vertically below an uppermost portion of the shield.

A yet further object is to provide a first stop shoulder on the shield spaced above the handle, when the handle extends generally horizontally, the first stop shoulder being engagable with the handle when said uppermost shield portion is pivoted rearwardly and upwardly to shield retracted position.

It is a yet further and important object of the invention to provide a versatile safety guide in combination with the slitter, to facilitate rapid, easy and accurate slitting of objects such as paste-board boxes, and the like, the guide carried by the slitter to slidably engage one surface of an object to be slit while the bladed projects in slitting relation to another surface of the slitter. The guide can, for example, be carried by the pivoted blade shield, as for example in a selected one of two guide positions. This enables a user to either snap a safety knife guide on the right or left side of the utility knife blade, depending on if he/she is left or right handed. This eliminates need to have a separate cutter for left handed and right handed individuals. A user can also operate the utility knife without a guide in place. The utility knife is not limited to cutting box or paper stock. It is also used to slit film, foil, plastics, strapping, wallpaper, vinyl, leather, and other items usually requiring slitting by a utility knife.

One objective of such a guide is to help the user cut the top of a box off from the side instead of the top. The guide rests on the box top while the blade penetrates the side and cuts it (the top) off. The guide also protects the user from injury should the utility knife slip while in the process of cutting. The guide can also be used to cut the top of a box off from the top position. A right handed user would simply snap the safety knife guide in the right handed slot and cut down on the box using the safety knife guide along the right side of the box as a guide. A left-handed user would do the opposite.

These and other objects and advantages of the invention, as well as the details of an illustrative embodiment, will be more fully understood from the following specification and drawings, in which:

DRAWING DESCRIPTION

FIG. 5 is an enlarged fragmentary view, partially cut away to show internal construction;

FIG. 6 is a section taken on lines 6—6 of FIG. 5;

FIG. 7 is a section taken on lines 7—7 of FIG. 5 to show interconnected plastic body sections, and two pivots;

FIG. 12 is a view of the slitter, having a guide mounted thereon, with the retracted and extended positions of the guide being shown;

FIG. 13 is an enlarged view of a further detailed guide;

FIG. 14 is an edge view of the FIG. 13 guide, taken on lines 14—14;

FIG. 15 is an enlarged section taken on lines 15—15 of FIG. 14;

DETAILED DESCRIPTION

Figure 1:
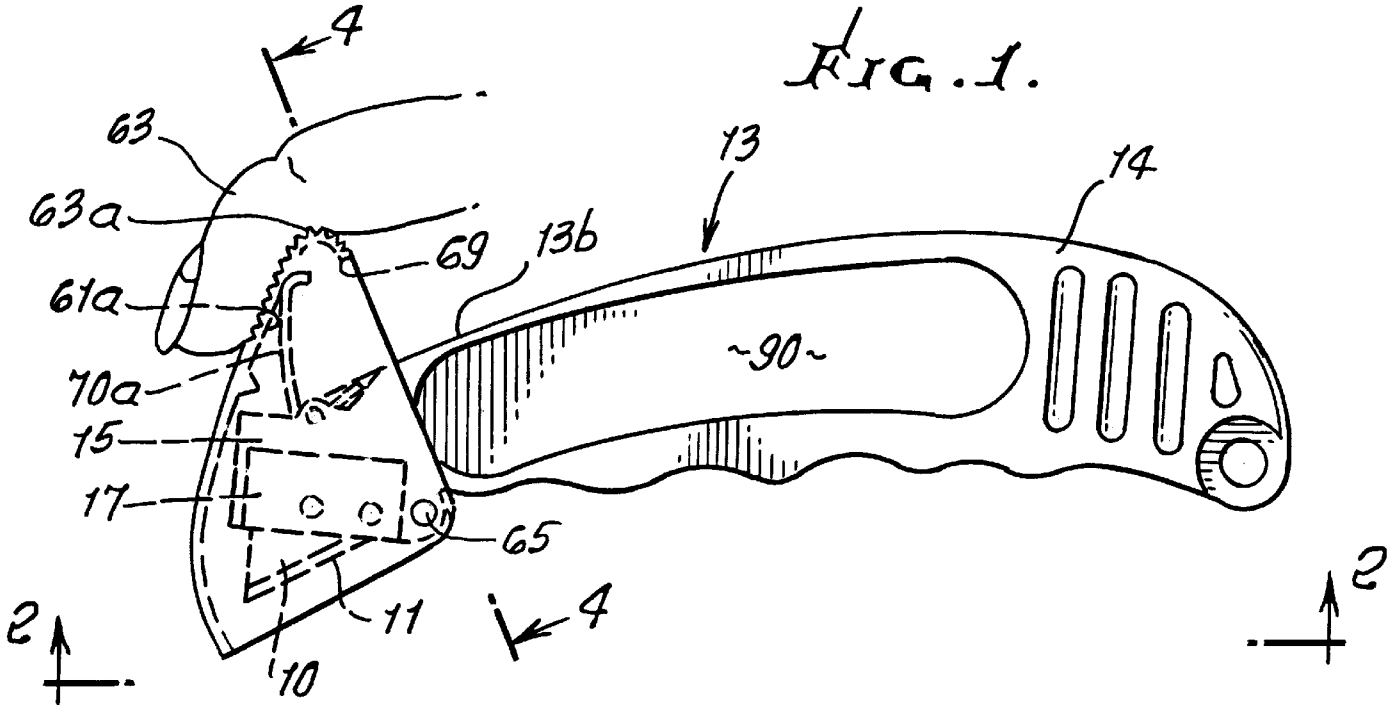
FIG. 1 is a left-side view of the device of the invention, with the blade shield in extended position.
Figure 2:
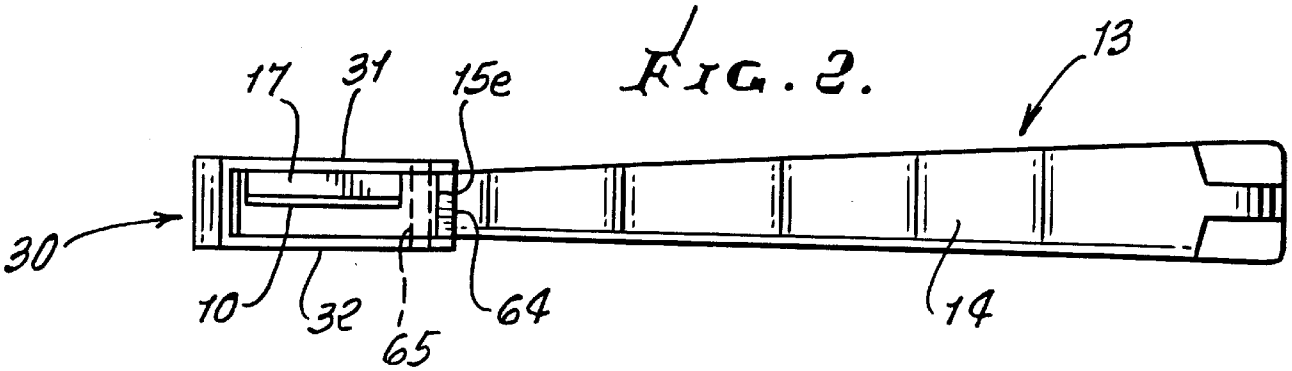
FIG. 2 is a bottom view taken on lines 2—2 of FIG. 1.

In the drawings, a thin, metallic, blade 10 has a lower, straight cutting edge 11, for slitting a panel 12. The latter may be provided by a pasteboard box, or other item needing slitting, as for opening.

A holder 13 for the blade includes an elongated handle 14, which may be curved, as shown and have side cutouts 90. The handle typically consists of low-cost molded plastic material, adapted for throw-away after the device is used. The handle has a curved terminal portion 15 at which the blade is retained. Terminal portion 15 defines a first, shallow, flat, generally rectangular recess 16 to receive a flat, rectangular insert plate 17, which may consist of plastic material, and may be adhesively bonded to the plastic handle terminal portion. Recess 16 is bounded on three sides by linear shoulders 18, 19 and 20 closely confining corresponding edges of plate 17.

The insert plate 17 has an inner side 17*a* seating flatly against the inner wall 16*d* of recess 16, as shown in FIG. 6. Plate 17 may be adhesively connected to terminal wall 16*d*, and in addition rivets 40 and 41 connect the plate to handle terminal portion 15*a*, in the manner seen in FIG. 6. This construction affords sturdy, stable positioning and locating of blade 10, the upper portion 10*a* of which is received in a shallow second recess 22 sunk in wall 16*d*. That recess has edges seen at $16d_1$, $16d_2$ and $16d_3$, in FIG. 5, to edgewise confine the blade upper edges to transfer loading directly to the handle terminal 15, during cutting. Note in FIG. 6 the flat stable engagement of opposite sides of the blade with surfaces of the insert plate and of the second recess, the rivets 40 and 41 extending through those elements, further enhancing stability.

A shield 30 (of molded plastic construction) is carried by the holder 13, proximate terminal 15, for movement between extended position in which the blade is protected (see FIG. 1) and retracted position (see FIG. 3) in which the blade edge 11 is exposed for cutting. The shield has two parallel side plates or wall sections 31 and 32 at opposite sides of the terminal 15, with lower protective edges 31*a* and 32*a*.

The wide spacing of edges 31*a* and 32*a* assures stability, during slitting, with blade 10 held normal to that surface.

The thin side plates 31 and 32 are positioned to travel closely adjacent opposite sides 15*b* and 15*c* of the terminal, and to be held in position, as by protective structure extending between those plates. See for example interconnecting webbing 60 extending at the front or nose of the shield, and 61 extending at the upper side of the shield. Such webbing at the upwardly projecting rear 62 of the shield may have an undulated outer surface 62*a* for engagement by the user's finger or thumb that pushes i.e., pivots the shield back to FIG. 3 position, for facilitating cutting. See the forefinger 63 in FIG. 1, wrapping over the projection 62, configured and tapered to fit into the finger fold 63*a* for ease and better control of shield positioning.

A pivot means interconnection between the shield side plates and the handle is provided, proximate a retainer 64 that extends between and is integral with the side plates near their lower edges. That retainer assists in keeping or holding the plates adjacent the opposite sides 15*b*, and 15*c* of the terminal 15. The retainer 64 is near the trunnion pivots 65, and at corners 31*c* and 32*c* of the side plate that remain near the terminal 15, during shield retraction, as is clear from FIG. 5. Therefore, the shield is retained on the terminal 15, in all shield positions. Note the blade edge 11 extending in skewed relation to terminal 15 and to the lower edges 31*a* and 32*a*, but out of engagement with the retainer 64. That retainer may also engage the underside of the terminal, in shield retracted position. See FIG. 3.

The shield pivot means advantageously includes the two trunnions 65 projecting from opposite sides of the terminal 15 (see FIG. 7), for reception through openings 31*e* and 32*e* in the shield side plates. Retainer 64 keeps those side plates from spreading free of the pivot trunnions.

Figure 3:
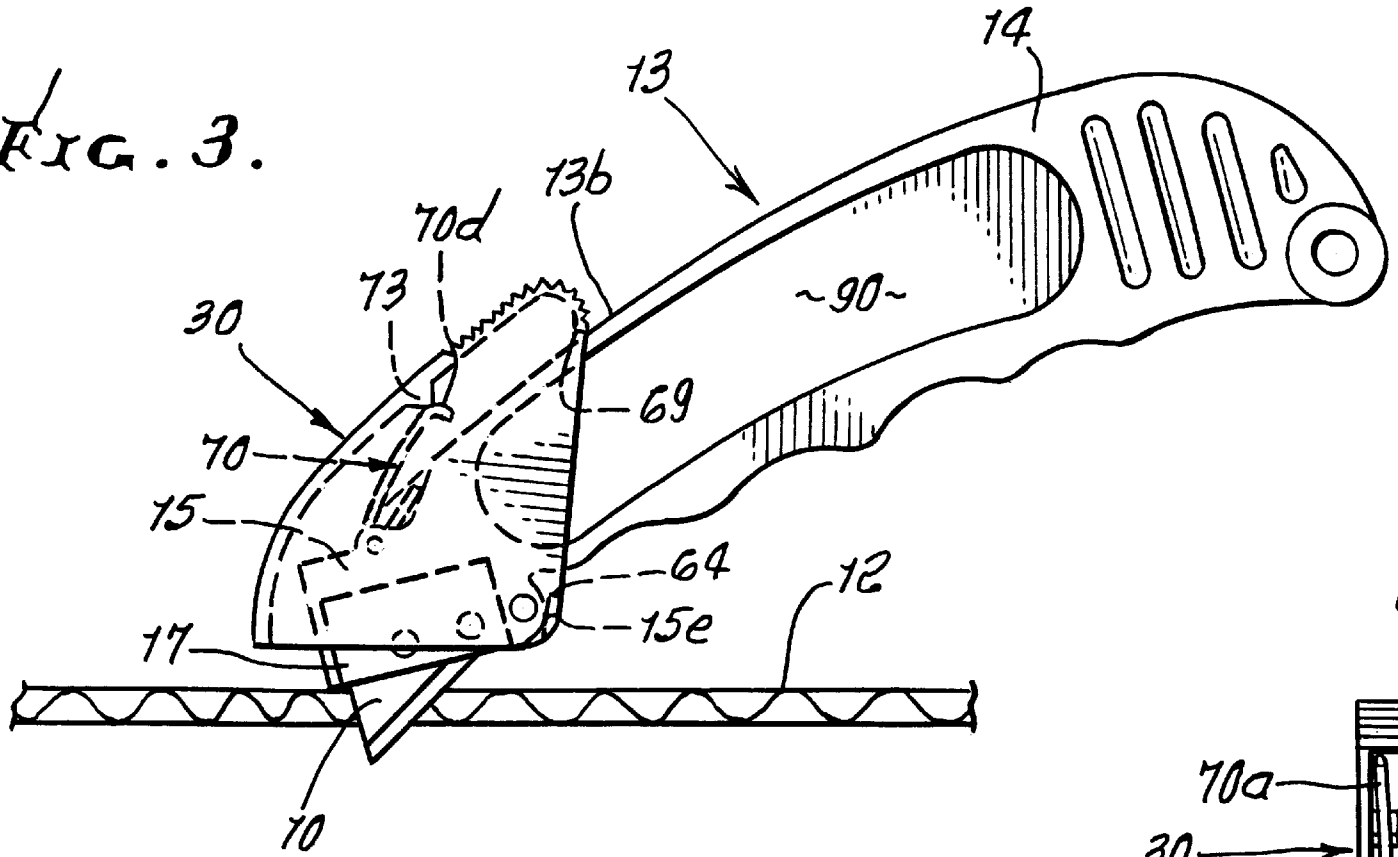
FIG. 3 is a view like FIG. 1, but showing the exposed blade, in box cutting use.
Figure 4:
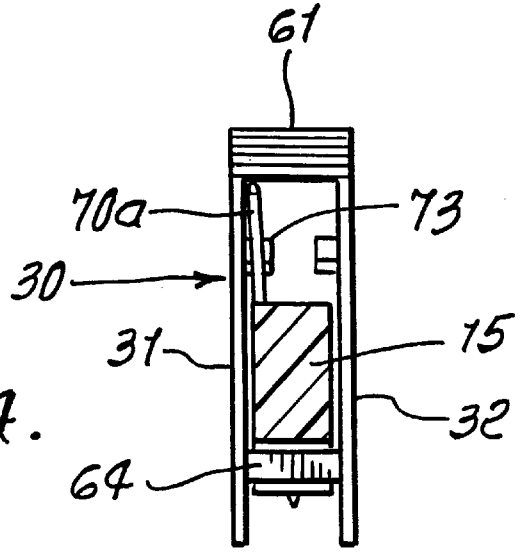
FIG. 4 is an end view taken on lines 4—4 of FIG. 1.
Figure 8:
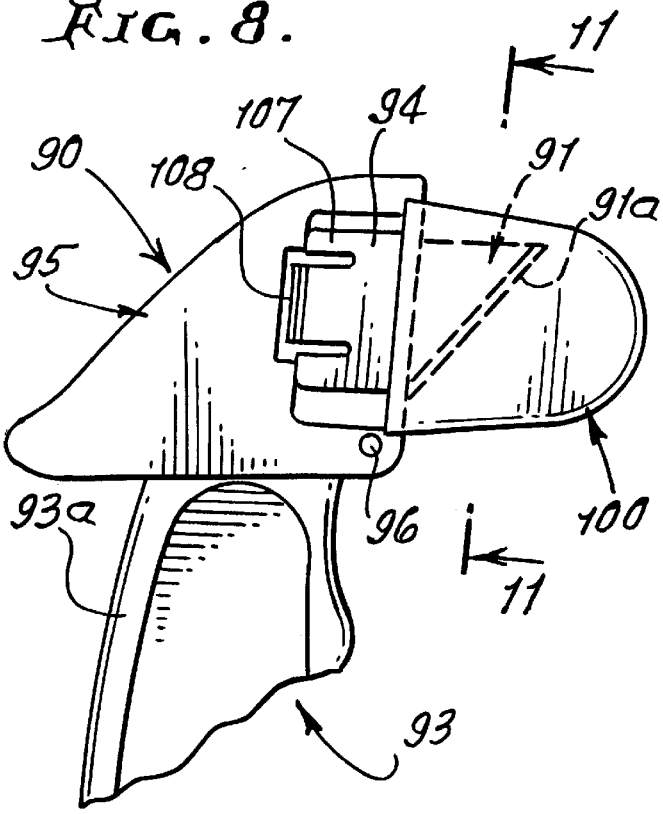
FIG. 8 is a side elevation showing a slitter device having a guide mounted thereon.

A stop shoulder 69 is provided on the shield projection 62 as seen in FIGS. 1, 3 and 5. It is engaged with the top wall 13*b* of the handle in shield retracted position, to limit such retraction, as seen in FIG. 3.

A metallic torsion spring 70, best seen in FIG. 5 as located within a hollow 80 defined by the shield, has a coil 70*c* wrapped about a transverse pin 71 carried by the handle end portion 15, as seen in FIG. 6. The coil is located in a recess 72 in 15. The spring has an arm 70*a* having cam engagement with the shield, as at projection 73 in FIG. 5, and an arm 70*b* engaging wall 72*a* of the small recess 72. The spring urges the shield counterclockwise as in FIG. 1, with arm 70*a* riding against inner surface 61*a* of wall 61. Tapered projection 73 on wall 61 has ultimate cam engagement with the turned end 70*d* of the spring arm 70*a*, as seen in FIG. 5, tending to hold the shield in retracted position during cutting, a detent action thereby being provided.

The device of the invention is highly compact, made of molded plastic, is of low-cost construction, and is adapted for throw away after use. At the same time, the blade is firmly retained and is well protected by the shield, except during use to slit pasteboard, as referred to, whereby the device is very safe.

A further and preferred form of the invention is embodied in the views of FIGS. 8–19 showing a guide incorporated on the slitter, to slidably guide along one surface of an object, while the blade penetrates and slits another surface or wall of the object.

As seen in FIGS. 8–12, the modified slitter 90 has a blade 91 with a straight cutting edge 91*a*, for slitting work, such as a panel or box, for example a box top. The edge of the work is seen in FIG. 12 at 92. The construction of the slitter is generally the same as in FIGS. 1–7, and includes a holder 93 that includes handle 93*a*, insert plate 94 to position blade 91 and carried by the handle forward extent, and a shield 95 like shield 30, pivoted at 96 to the holder 93. The shield is spring urged toward extended position, indicated at 95*a* in FIG. 12, in which the blade is concealed, to protect against engagement with a user's finger. A shield upper projection 97 has an undulating or serrated upper rear surface at 97*a*, allowing finger retraction (pivoting) of the shield toward rearward and upward retracted position, indicated at 95*b* in FIG. 12.

In accordance with this preferred form of the invention, provision is made for a guide to be carried by the slitter to slidably engage one surface of an object to be cut while the blade projects in slitting relation to another surface of the object. Preferably, the guide may be carried by the shield 95, to pivot therewith. See for example the guide 100 in FIGS. 8 and 12, carried by shield 95. In guide retracted position it projects longitudinally forwardly at 100*b*, and also laterally sidewardly of the exposed blade 91; and in guide extended (and pivoted) position, it projects at 100*a* forwardly and rearwardly, relative to the handle, as shown. Therefore, the blade remains sidewardly protected at one side by the guide 100 when the blade has been exposed by shield retraction. Also, a very compact assembly is achieved.

Figure 11:
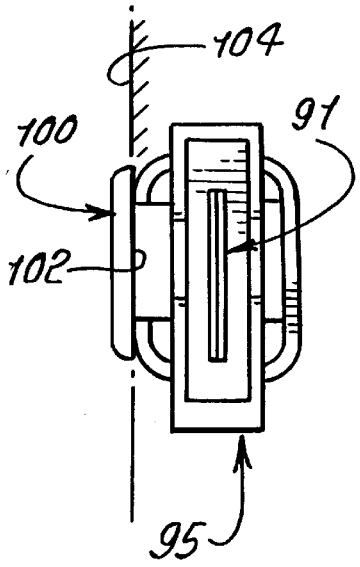
FIG. 11 is a view of slitter mechanism taken on lines 11—11 of FIG. 8.
Figure 9:
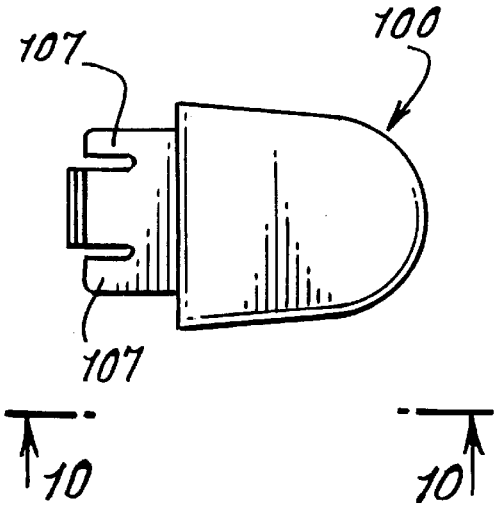
FIG. 9 is a side elevation of the guide seen in FIG. 8.
Figure 10:
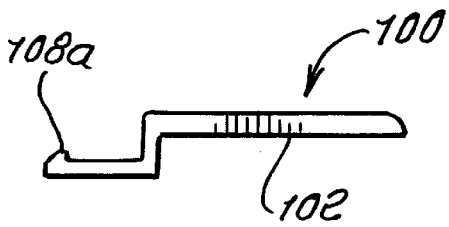
FIG. 10 is a view of the guide taken on lines 10—10 of FIG. 9.
Figure 16:
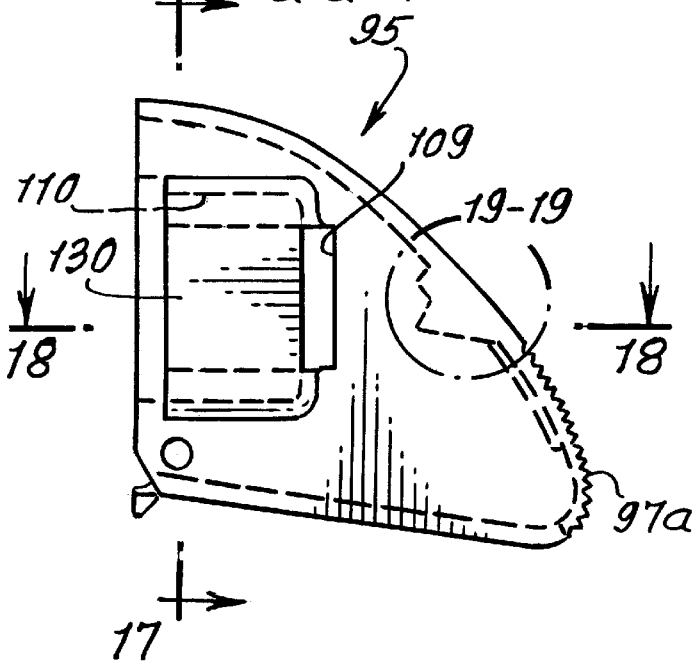
FIG. 16 is an enlarged side elevation of a further detailed knife shield.
Figure 17:
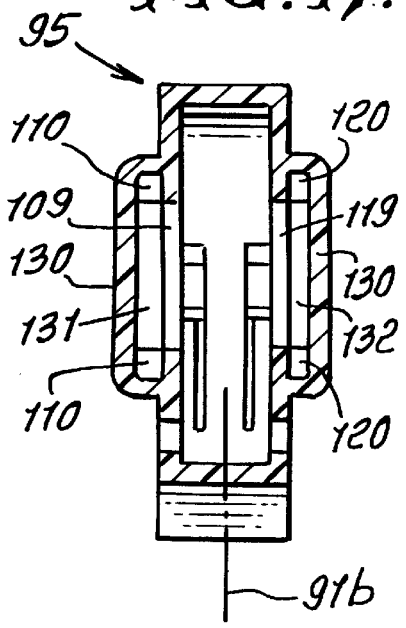
FIG. 17 is a section taken on lines 17—17 of FIG. 16.
Figure 18:
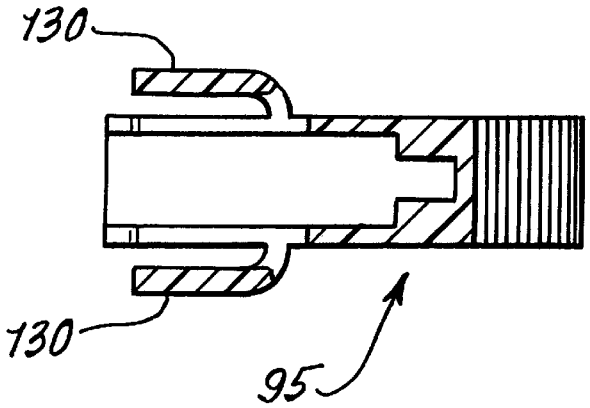
FIG. 18 is a section taken on lines 18—18 of FIG. 16.

Referring to FIGS. 13–15, as well as FIGS. 9–11, the guide 100 has the form of a plate, with a flat guide surface 102 slidably engagable with the top wall of a box, at the same time the slitter blade penetrates and slits the box side wall. The guide plate may have shallow convex protuberances 102*a*, to slidably engage the box, or surface being cut, lowering friction.

With reference to FIGS. 13 and 14, the guide is also shown to have a leg or legs 107, extending in a plane 107*a* parallel with the guide surface 102, but offset from the plane of surface 102. A tongue 108 is located between legs 107, and has a sideward projection at 108*a* that fits in a slot 109 (see FIG. 17) formed in the shield body. Legs 107 fit endwise in slot or slots 110 formed in the shield. Slots 109 and 110 may be regarded as frictional connections for the guide legs and tongue to the shield.

Alternate and like slots 119 and 120 are preferably also formed in the shield, at the opposite side of the blade plane, i.e. in mirror imaged relation to slots 109 and 110, with respect to the blade plane. This enables use of the slitter, blade and guide by an "opposite" handed person, such as a left-handed person, and with legs 107 received in 119, and tongue 108 received in slot 120. In this regard, the guide legs and tongue may have endwise inserted friction fit into the described slots, for guide retention in position on the shield, during use, and also enabling ready reversal of the guide, i.e., fit into the alternate slots, at opposite sides of the blade plane. In either position, the guide surface 102 faces the plane of the blade. Also, there is then no need to change the blade, the slitter being disposable. Note laterally outwardly offset side walls 130 of the shield, in FIG. 17, to provide spaces 131 and 132 for reception of the guide body.

Figure 19:
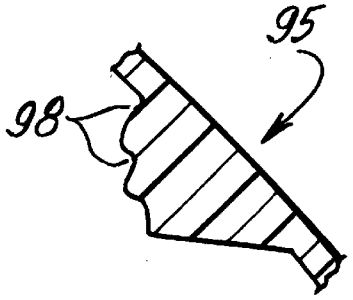
FIG. 19 is an enlarged section taken on lines 19—19 of FIG. 16.

FIG. 19 shows multiple notching at 98 at the inner side of the shield to engage spring arm 70*a* in multiple detent positions.

The present device and/or components thereof, except for the cutter blade, can be made from plastic or other hard material, providing structural integrity.

The present device incorporates improvements over those of my prior devices as disclosed in U.S. Pat. Nos. 5,522,135 and 5,697,157, incorporated herein by reference, and is particularly adapted for heavy duty use.

I claim:

1. In a slitter, the combination comprising:

a) a blade having a cutting edge, b) a holder for the blade, including a handle, and a terminal on the handle retaining the blade with the blade edge protruding, c) a shield carried by the holder proximate said terminal, for movement between an extended position in which the blade is protected, and a retracted position in which the blade edge is exposed for cutting, d) there being a torsion spring carried by the holder and having an arm biasing the shield toward the extended position, e) the spring arm projecting in a hollow defined by the shield, the shield extending parallel to the blade, at opposite sides thereof.

2. The combination of claim 1 wherein said spring arm has camming engagement with a surface carried by the shield, whereby said surface slides along the spring arm, lengthwise thereof, as the shield moves between retracted and extended positions.

3. The combination of claim 2 wherein a projection is provided on the shield, in said hollow, to engage a turned portion of the spring arm tending to hold the shield in the retracted position.

4. The combination of claim 2 wherein the torsion spring has a second arm located on a recess defined by the holder.

5. The combination of claim 1 wherein the shield has an uppermost projecting portion extending above the level of said terminal when the handle extends generally horizontally, for engagement with a user's finger or thumb when the handle is gripped, whereby the shield may be moved to the retracted position by finger or thumb pressure exerted on said uppermost portion.

6. The combination of claim 1 wherein the holder includes an insert plate carried by the terminal, the blade carried proximate the insert plate with the blade edge projecting in a skewed relation to a lower edge defined by the insert plate, below the torsion spring, the shield having a forward portion extending protectively forwardly of the blade in the blade extended position.

7. The combination of claim 5 wherein said shield uppermost portion tapers upwardly and rearwardly above the blade and the spring, in said blade extended position.

8. The combination of claim 1 wherein said shield has an uppermost portion extending above the level of said terminal when the handle extends horizontally, and said shield has opposite side sections at opposite sides of said terminal, said opposite side sections pivotally attached to said terminal generally vertically below said shield uppermost portion.

9. The combination of claim 1 wherein said shield has an uppermost portion extending above the level of said terminal when the handle extends horizontally, and including a first stop shoulder on the shield spaced above the handle, when the handle extends generally horizontally, said first stop shoulder being engagable with the handle when said uppermost portion is pivoted rearwardly to said shield retracted position.

10. The combination of claim 1 including a guide carried by the slitter to slidably engage one surface of an object to be slit while the blade projects in slitting relation to another surface of the object.

11. The combination of claim 10 wherein the guide has a guide surface, and the blade defines a plane generally parallel to said guide surface.

12. The combination of claim 10 wherein the guide is carried by the shield for movement therewith between its extended and retracted positions.

13. The combination of claim 12 wherein the guide has releasable attachment to the shield.

14. The combination of claim 13 wherein the shield has connections at opposite sides of a plane defined by the blade for alternative releasable attachment to the guide.

15. The combination of claim 14 wherein the guide has legs, and the shield has first slots to interfit the guide legs in a first selected position of the guide relative to a plane defined by the blade, and the shield has second slots to interfit the guide legs in a second selected position of the guide, relative to said plane.

16. The combination of claim 13 wherein the guide has legs, and the shield has slots to interfit said guide legs.

17. In a slitter, the combination comprising:

a) a slitter blade and a handle carrying said blade, b) a shield carried by the handle and pivotable between an extended position in which the shield extends in a protective position relative to the blade, and a retracted position, in which the blade is exposed for slitting, c) a spring located to urge the shield toward the extended position, d) the spring having an elongated arm, and the shield having a projecting portion defining a hollow to increasingly receive the spring arm as the shield pivots toward the extended position, e) said projecting portion of the shield adapted to be finger-gripped to effect shield pivoting.

18. In a slitter, the combination comprising:

a) a blade having a cutting edge, b) a holder for the blade, including a handle, and a terminal on the handle retaining the blade with the blade edge protruding, c) a shield carried by the holder proximate said terminal, for movement between an extended position in which the blade is protected, and a retracted position in which the blade edge is exposed for cutting, d) and a guide carried by the slitter to slidably engage one surface of an object to be slit while the blade projects in slitting relation to another surface of the object, e) the guide having a guide surface and the blade defines a plane generally parallel to said guide surface, the guide carried for movement with the shield between its extended and retractable positions.

19. The combination of claim 18 wherein the guide is carried by the shield.

20. The combination of claim 19 wherein the guide has releasable attachment to the shield.

21. The combination of claim 20 wherein the shield has connections at opposite sides of said plane for alternative releasable attachment to the guide.

22. The combination of claim 21 wherein the guide has legs, and the shield has first slots to interfit the guide legs in a first selected position of the guide, and the shield has second slots to interfit the guide legs in a second selected position of the guide.

23. The combination of claim 20 wherein the guide has legs, and the shield has slots to interfit said guide legs.

24. A method of slitting an object, which includes:

a) providing a single blade having a cutting edge, b) providing a holder for the blade, including a handle, and a terminal on the handle retaining the blade with the blade edge protruding, c) providing a shield carried by the holder proximate said terminal, for movement between an extended position in which the blade is protected, and a retracted position in which the blade edge is exposed for cutting, and providing a torsion spring carried by the holder and biasing the shield toward said extended position, the spring having one arm projecting in a zone defined by the shield, the shield extending parallel to the blade, d) providing a guide carried to slidably engage one surface of an object to be slit while the blade projects in slitting relation to a second surface of the object, e) moving said holder relative to said object to cause said guide to slidably engage said one surface of the object while the blade projects in slitting relation to said second surface of the object.

* * * * *